US006475126B1

(12) United States Patent
Hay, Jr.

(10) Patent No.: US 6,475,126 B1
(45) Date of Patent: Nov. 5, 2002

(54) HAND-HELD ISOKINETIC EXERCISE DEVICE AND METHOD OF USE

(76) Inventor: E. H. Taylor Hay, Jr., 4480 Harp Pl., Frankfort, KY (US) 40601

( * ) Notice: Subject to any disclaimer, the term of this patent is extended or adjusted under 35 U.S.C. 154(b) by 0 days.

(21) Appl. No.: 09/348,510

(22) Filed: Jul. 7, 1999

(51) Int. Cl.[7] ..... A63B 21/002; A61H 7/00

(52) U.S. Cl. ..... 482/131; 482/49; 482/91; 482/121; 482/907; 601/138

(58) Field of Search ..... 482/44, 91, 92, 482/106, 108, 109, 131, 139, 49, 50, 148, 51, 905–907, 110, 122, 126, 128, 100, 38, 121; 601/135, 137, 138; D21/662

(56) References Cited

U.S. PATENT DOCUMENTS

| | | | | | |
|---|---|---|---|---|---|
| 1,005,791 | A | * | 10/1911 | Angell | 482/109 |
| 1,316,570 | A | * | 9/1919 | Friedrich | 482/93 |
| 4,039,185 | A | * | 8/1977 | Rhodes | 482/906 |
| 4,211,402 | A | * | 7/1980 | Carroll | 482/139 |
| 4,417,727 | A | * | 11/1983 | Ottenheimer | 482/91 |
| 4,466,610 | A | * | 8/1984 | Israel | 482/91 |
| 4,673,179 | A | * | 6/1987 | Pengler | 482/139 |
| 4,973,043 | A | * | 11/1990 | Nolan | 482/106 |
| D320,054 | S | * | 9/1991 | Yanazaki | 482/91 |
| 5,312,314 | A | * | 5/1994 | Stephan et al. | 482/106 |
| 5,316,531 | A | * | 5/1994 | Spence | 482/106 |
| 5,769,758 | A | * | 6/1998 | Sarkinen | 482/44 |
| 5,921,902 | A | * | 7/1999 | Carpenter | 482/139 |
| 6,190,291 | B1 | * | 2/2001 | Schwarz | 482/148 |

FOREIGN PATENT DOCUMENTS

| | | | | |
|---|---|---|---|---|
| AU | OE 0134489 | * | 8/1933 | 482/44 |
| CA | 646555 | * | 8/1962 | 482/91 |

OTHER PUBLICATIONS

Bodybuilder's Discount Outlet, 1995 summer catalog, pp. 41–42 showing various cable attachment bars.*

* cited by examiner

*Primary Examiner*—Glenn E. Richman
*Assistant Examiner*—Victor Hwang
(74) *Attorney, Agent, or Firm*—King & Schickli, PLLC

(57) ABSTRACT

A hand-held exercise device is described which positions the user's hands and wrists at an appropriate angle to minimize stress on the joints and ligaments, while allowing an isokinetic workout tailored to the user's own flexibility and strength. A method of using the exercise device is also described.

11 Claims, 4 Drawing Sheets

HAND-HELD ISOKINETIC EXERCISE DEVICE AND METHOD OF USE

TECHNICAL FIELD

The present invention relates to a device for physical exercise, specifically a hand-link device, which allows isokinetic, stretching, isotonic, and aerobic conditioning without danger of injury to muscle, joints, or internal organs.

BACKGROUND OF THE INVENTION

Many exercise devices depend on weight, force or speed in repetitions which utilize springs, weights, elastic straps, pistons, gears, fixed pedals, pulleys, and other mechanical components. These other devices artificially limit range of natural motion, exerting undue force on isolated parts of the exerciser's body, and committing the exerciser to a specific weight, force or speed inherent to the device.

Many prior art exercise devices fix or position the user's body into a single plane, with a limited range of motion, or require retention of certain parts of the body in rigid or awkward positions. Such prior art exercise devices may cause damage to bodily joints, by forcing the joints to grind or compress against one another in order to accommodate weight, force, speed, limited range of motion, unnatural body position, or unnatural directions of motion inherent in the machines' design. Machines such as "pulley and weight" machines can result in hyperextension of ligaments. Other machines position the exerciser in a manner which compresses spinal vertebrae.

In particular, many prior art exercise devices cannot duplicate natural motions of the body. In effect, the exercise device "controls the user", rather than vice-versa. Oftentimes, injury is caused due to a user's endurance, strength, or energy suddenly abating in the middle of an exercise movement, when the user is already committed to a fixed resistance, weight, or speed. Prior art exercise devices are unable to adjust force, weight, or speed, and overstress or injury can result.

It is known in the art to overcome the above-cited disadvantages in existing exercise methods utilizing exercise devices by use of isokinetic exercise, or the use of resistance against one's own muscles to exercise muscles, increase heart rate, and the like. Typical examples of this exercise type include, e.g. locking the hands and attempting to pull them apart, or pressing the palms together to create muscle tension. Muscle tension created thereby results in concomitant tension to other muscle groups, thereby providing exercise to the entire organism. Additionally, the act of creating muscle tension raises the heart rate, with concomitant aerobic benefits to the individual exercising.

While the advantages of isokinetic exercise as described above are known, certain disadvantages inherent to exercise without any type of device remain. Elderly and injured people often suffer from a lack of hand strength, reducing the benefits of such exercise programs due to inability to lock the hands together with any real force. Persons with extremely long fingernails are similarly often unable to lock their hands together with any real force without injury. During periods of strenuous exercise, sweating may reduce the ability to retain a grip on interlocked hands or fingers, further reducing effectiveness of the exercise undertaken. Finally, some individuals are desirous of performing isokinetic exercise with greater force than is possible merely by use of the bare hand, and require a larger surface to grip than the palms of their hands to allow imposition of increased force.

It is also known that improper positioning of the hands and wrists during isokinetic exercise may reduce the effectiveness of the exercise, and increase the risk of a repetitivemotion type injury. Maintenance of even pressure when pulling or pushing on the bare hand is difficult, further increasing the risk of injury and reducing the effectiveness of the exercise.

Accordingly, there is need in the art for an exercise device designed to be incorporated into a program of isokinetic exercise which allows the user to exert significantly greater force than possible by use of the bare hand. Such an exercise device should be usable by persons with diminished hand strength, such as the elderly or the injured, and still allow the user to reap full benefits of the exercise undertaken. It is further a need in the art for an exercise device which correctly positions the user's hands and wrists to maximize the beneficial effects of exercise utilizing the device, while minimizing the risk of injury to joints or ligaments.

SUMMARY OF THE INVENTION

In accordance with the purposes of the present invention as described herein, an exercise device is described. The device of the present invention is a substantially U-shaped device, comprising a solid core with a softer, resilient covering. The device allows the user to gain the benefits of isokinetic exercise without the inherent disadvantages of such exercise using only the bare hands.

In a preferred embodiment, the core of the exercise device is constructed of steel tubing. However, it should be appreciated that any material providing sufficient resistance, such as iron, high-strength plastics, or other composites may be suited to the present invention. In a preferred embodiment, the device of the present invention is covered in a thick, resilient material such as foam tubing, allowing compression of the device in conjunction with the traditional pushing and pulling motions of isokinetic exercise. As will be appreciated, the device of the present invention can be designed to be any number of weights or sizes to accommodate the particular needs of the user.

In yet another aspect of the present invention, a method of using the exercise device of this invention is described, whereby the user utilizes the device as a hand-link, enhancing the natural benefits of isokinetic exercise.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Reference will now be made in detail to the presently preferred embodiment of the invention, an example of which is illustrated in the accompanying drawings.

DETAILED DESCRIPTION OF THE INVENTION

Figure 1:
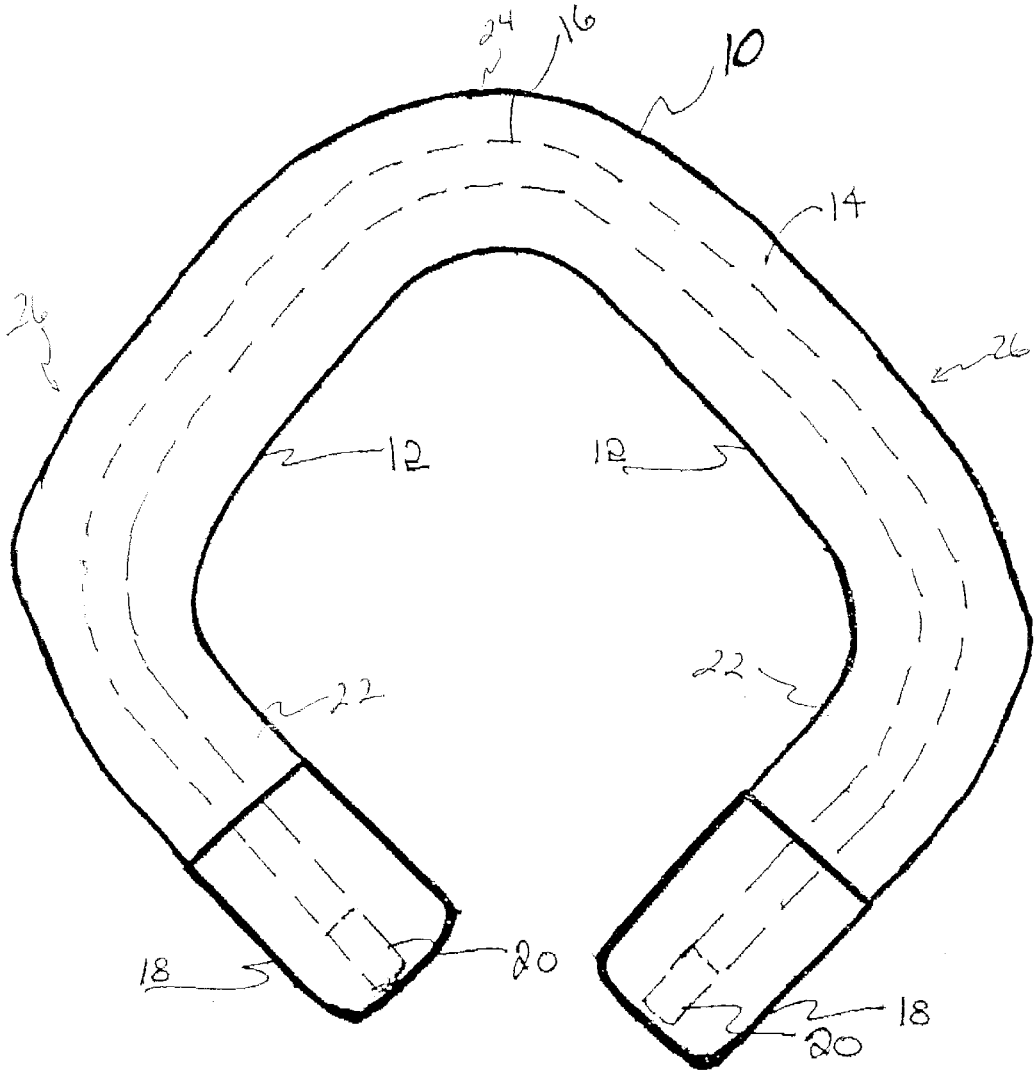
FIG. 1 is a frontal view showing the exercise device of the present invention.
Figure 2:
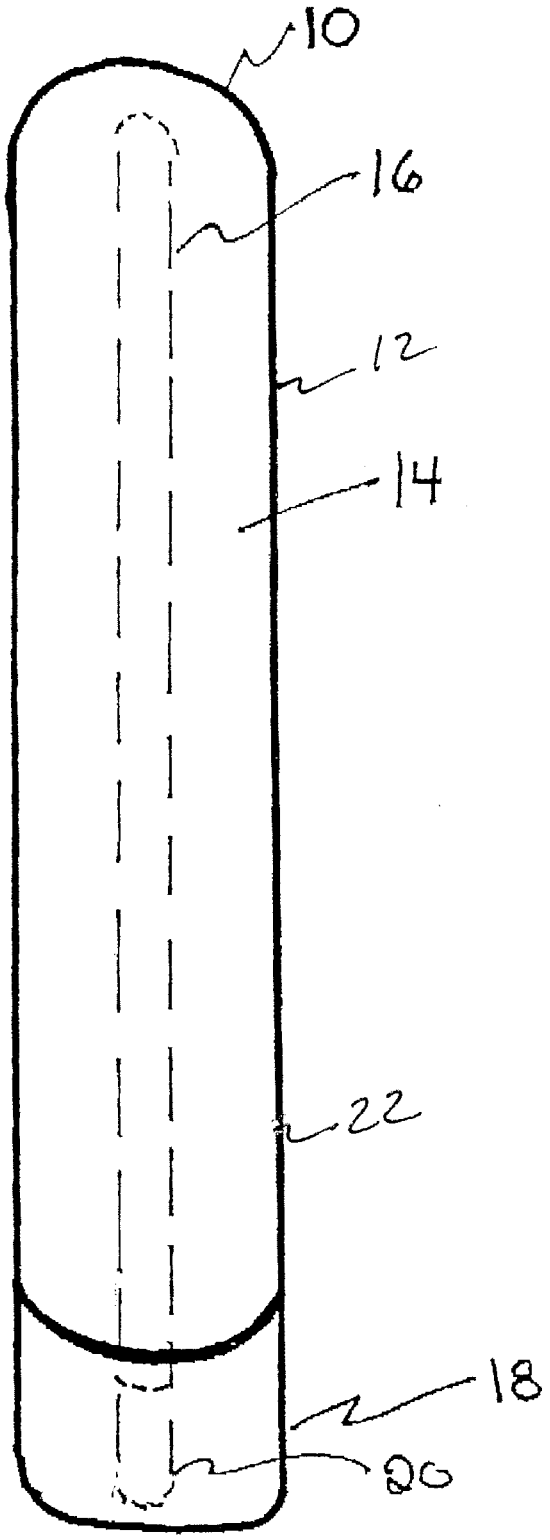
FIG. 2 is a side view showing the exercise device of the present invention.
Figure 3:
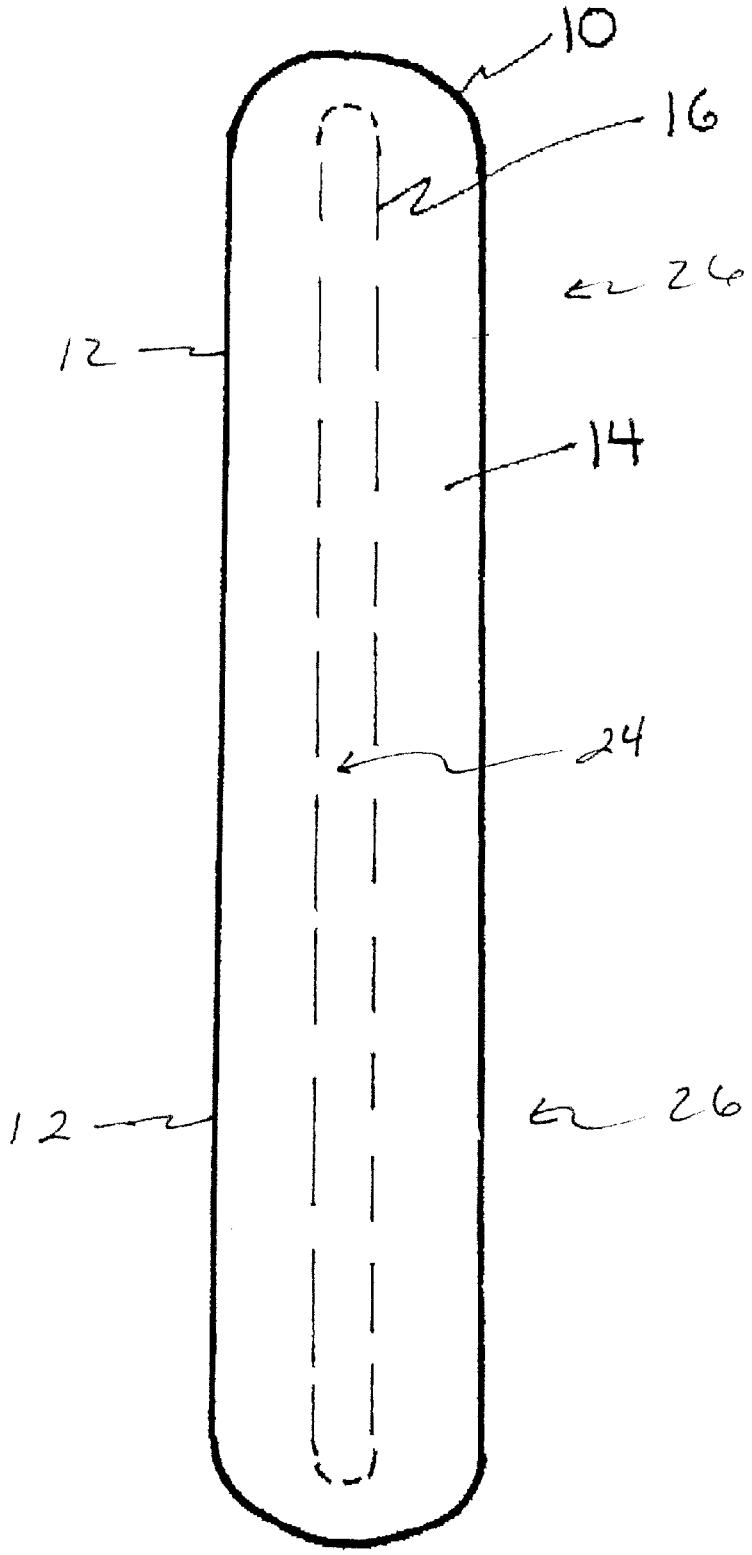
FIG. 3 is a top view showing the exercise device of the present invention.
Figure 4:
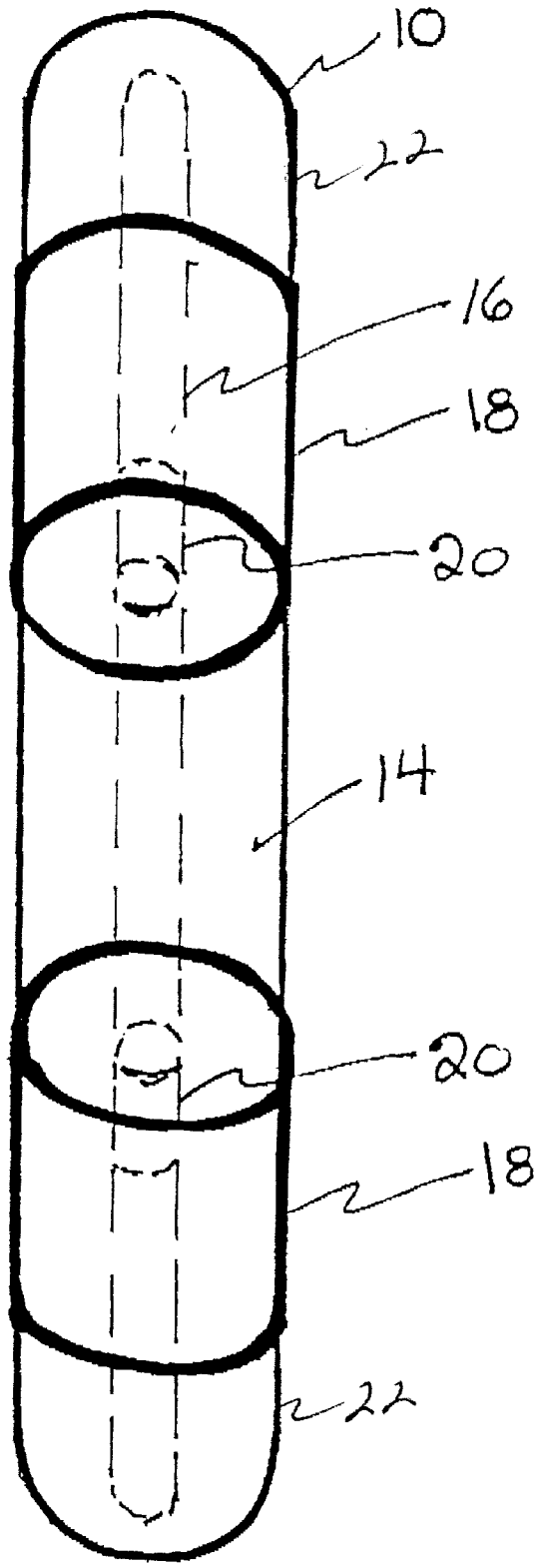
FIG. 4 is a bottom view showing the exercise device of the present invention.

Reference is now made to the Figures, which illustrate the exercise device 10 of the present invention. As shown in FIG. 1, the portable, ergonomically shaped exercise device 10 comprises a substantially rigid, U-shaped core 16 having a centerpoint 24 and two opposed arms 26 extending laterally therefrom. The distal ends of the U-shaped core 16 maybe covered with end caps 20 to prevent incidental contact with the core. In a preferred embodiment, the U-shaped core of the present invention is steel. However, it should be appreciated that any material which is substantially rigid and resistant to bending is suitable for this device, including, e. g. iron, aluminum, fiberglass, plastics, wood, or any of a number of suitable polymers. In a presently preferred embodiment, the device of the present invention is approximately 21 inches in length, with a cross sectional diameter of approximately 1.5 inches. However, it should be appreciated that the exercise device 10 of the present invention may be manufactured to be any desirable weight or size, depending on the needs of the individual user, i.e. individual strength level, hand size, and the like.

Each of the arms 26 comprises a first segment 12 extending away from the centerpoint of the U-shaped core 16, terminating in a distal end and forming a first angle therebetween. In a currently preferred embodiment, the first segment 12 of the invention measures approximately 5 inches in length. However, the first segment 12 may be any length required, in accordance with the particular hand size of the user. The opposed arms 26 extend laterally from the centerpoint 24 in a substantially identical plane. In a presently preferred embodiment of the present invention, the opposed arms extend laterally from the centerpoint 24 at a first acute angle. In a particularly preferred embodiment, the opposed arms 26 extend laterally from the centerpoint 24 at a first angle of about 36 degrees. Accordingly, the user's wrists and hands, when exercising with the exercise device 10 of the present invention, are placed at the most appropriate angle to assure minimum stress on the joints and ligaments of the user's hands and arms.

In a most preferred embodiment of the present invention, each of the opposed arms 26 of the exercise device 10 further comprise a second segment 22 extending from the distal end of the first segment 26 in a substantially identical plane. In a preferred embodiment, the second segment 22 extends from the distal end of the first segment 26 at a second angle. Accordingly, the device of the present invention allows alternating hand positions while exercising, thereby changing the muscle groups exercised while still maintaining the proper wrist and hand angles to minimize stress on the joints and ligaments.

The exercise device 10 of the present invention further comprises a resilient, compressible covering 14, suitable for gripping and squeezing, substantially overlaying the substantially rigid, U-shaped core 16 and providing a sweat-resistant surface of increased diameter, thereby reducing hand fatigue during exercise. In a currently preferred embodiment of the present invention, the resilient, compressible covering 14 of the present invention comprises loam tubing. However, it must be appreciated that any material which provides a suitably resilient, compressible covering is anticipated. For example, other materials such as, e.g. urethane, rubber, or any suitably compressible polymer are equally suited to the device of the present invention. Accordingly, the compressible covering 14 of the present invention adds an additional element to exercising with this invention. Specifically, in conjunction with contracting/stretching movements which will be described in greater detail infra, the user may exert an appropriate amount of force in squeezing the compressible covering 14 of the present invention, thereby exercising the muscles and ligaments of the wrists, hands, and arms simultaneously. In a presently preferred embodiment, the compressible covering 14 has an approximate diameter of 1.5 inches. Of course, any suitable diameter is anticipated, said diameter designed to substantially match the needs of a user in accordance with the user's hand size, thereby minimizing hand fatigue while exercising with the device of the present invention.

The device of the present invention further comprises end caps 18 substantially overlaying the resilient, compressible covering 14 at the distal ends thereof, forming a massaging end. The end caps 18 may be made of any suitable material designed to protect the user from contact with the distal ends of the rigid, U-shaped core 16. In a presently preferred embodiment, the end caps 18 comprise soft vinyl. Advantageously, the end caps 18 serve the additional purpose of providing a means for massaging the muscles of the body either before or after exercise with the device of the present invention. The end caps 18 are positioned to advantageously allow massage of the muscles of the back to either side of the spine, and may be used to massage additional muscle groups.

In yet another aspect of the present invention, a method of using the exercise device 10 of this invention is described, whereby the user utilizes the device as a hand-link, enhancing tie natural benefits of isokinetic exercise. In one embodiment of the method of exercise of this invention, presented herein only by way of example, the user stands in an upright, natural posture equally balanced on both feet, grasps the opposed arms 26 of the exercise device 10 in each hand, and exerts sufficient pulling force with the right hand to turn the user's torso to the right, while shifting the weight to the right foot. This initial movement causes contraction of the muscles of the user's body in the direction of the pull, while simultaneously effecting stretching of the muscles of the left side of the user's body. Simultaneously, the user turns the head in the opposite direction of the pulling force, thereby stretching the muscles of the neck, back and spine. Advantageously, the exercise method of this invention allows the user to challenge the limits of the user's strength, endurance, flexibility and coordination, due to the ability to exercise safely to the user's maximum range of motion at the maximum comfortable application of strength or resistance. The user's body instantly senses changes in energy or potential points of injury, and adjusts its force and speed to prevent injury.

The user then repeats the motion to the alternate side, similarly causing contraction of the muscles of the user's body in the direction of the pull, while simultaneously effecting stretching of the muscles of the user's body opposite to the pulling direction. It should be appreciated that the exercise device 10 of this invention may be held in any of a variety of positions while performing the movements of the exercise method, thereby altering the specific muscle groups exercised. For example, the exercise device may be held in front of the face, over the head, below the belt, behind the back, or in any of a number of variations, each variation resulting in an alteration of the specific muscle groups exercised.

In another aspect of the exercise method of this invention further comprises repeating the motion with a pushing, rather than a pulling, force, for example exerting sufficient pushing force with the right hand to turn the user's body to the left, thereby causing contraction of the muscles of the right side of the user's body while simultaneously effecting stretching of the muscles of the left side of the user's body. The motion is then repeated to the right, stretching and contracting the alternate muscle groups.

In yet another aspect of the exercise method of this invention, the user repetitiously rotates the exercise device 10 in such a manner as to repeatedly invert the device, followed by restoration of the device to the upright position. As the user inverts the device, an effective amount of resistance is applied with one hand to provide an isokinetic workout for the muscles of the hand and arm of the opposing hand. Of course, the movement is then repeated with the alternate hand to provide equal amounts of resistance training for both arms. The inversion method of this invention may be practiced alone, or in combination with the pulling/pushing movements of the exercise method as described supra.

In still another aspect of the method of this invention, the user squeezes the resilient covering of the exercise device 10 with an effective amount of force, whereby the muscles of the user's hands and forearms are further exercised. Of course, this latter aspect of the exercise method of this invention may be practiced alone, or in combination with the pulling/pushing and inversion methods to provide still more challenging workouts for the user.

It should be appreciated that the exercise method of this invention comprises performing the above-described movements while grasping the opposed arms 26 of the exercise device 10 at either the first segments 26 or the second segments 22, thereby changing the angle at which the hands and wrists are placed but still maintaining an ergonomically correct orientation of the hands and wrists to reduce stress on joints and ligaments. Performing the movements of the exercise method of the present invention while altering the angle at which the hands and wrists are placed causes minor alterations in the specific muscle groups exercised, thereby contributing to the total effectiveness of the workout described herein.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A portable, handheld, ergonomically shaped exercise device comprising:

a substantially rigid, U-shaped core having a centerpoint and two opposed arms extending laterally therefrom and occupying a substantially common plane;

each of said arms comprising a first segment extending linearly away from the centerpoint of said U-shaped core, having a distal end and forming a first acute angle with a centerline of said U-shaped core passing through the centerpoint;

each of said arms further comprising a second segment extending linearly from the distal end of said first segment towards the centerline at a second angle relative to the first segment, and terminating at a massaging end oriented away from the centerpoint, such that said massaging ends are spaced and adjacent one another; and a resilient, compressible covering overlaying each of said first and second segments for grasping and squeezing by a user.

2. The exercise device of claim 1, wherein each said first acute angle is substantially 36 degrees.

3. The exercise device of claim 1, wherein each said massaging end includes an end cap covering said resilient, compressible covering.

4. A method of isokinetic exercise utilizing a portable, handheld, ergonomic exercise device having:

a substantially rigid, U-shaped core having a centerpoint and two opposed arms extending laterally therefrom and occupying a substantially common plane;

each of said arms comprising a first segment extending away from the centerpoint of said U-shaped core, having a distal end and forming a first angle relative to a centerline of said U-shaped core passing through the centerpoint;

each of said arms further comprising a second segment extending from the distal end of said first segment towards the centerline and away from the centerpoint and terminating at a second distal end, the second distal ends being adjacent and spaced from one another; and a resilient, compressible covering, suitable for gripping and squeezing, substantially overlaying each of the first and second segments of the substantially rigid, U-shaped core;

said method comprising:

a user grasping one of the opposed arms of said exercise device at said first segment in a first hand;

said user gripping the other opposed arm of said exercise device at said first segment in a second hand;

exerting sufficient pulling force with said first hand to turn said user's body in a first direction, such that said user's body is rotated in the first direction, thereby causing contraction of the muscles of said user's body located along said first direction while simultaneously effecting stretching of the muscles of said user's body located opposite said first direction;

sequentially exerting sufficient pulling force with said second hand to turn said user's body in a second direction, such that said user's body is rotated in said second direction, thereby causing contraction of the muscles of said user's body located along said second direction while simultaneously effecting stretching of the muscles of said user's body located opposite said second direction.

5. The method of claim 4, further comprising:

exerting sufficient pushing force with said first hand to turn the user's body in said second direction, such that the user's body is rotated in said second direction, thereby causing contraction of the muscles of said user's body located opposite said second direction while simultaneously effecting stretching of the muscles of said user's body located along said second direction;

sequentially exerting sufficient pushing force with said second hand to turn said user's body in said first direction, thereby causing contraction of the muscles of said user's body located opposite said first direction while simultaneously effecting stretching of the muscles of said user's body located along said first direction.

6. The method of claim 5, further comprising inverting said exercise device repetitiously, thereby exercising the muscles of the user's arms.

7. The method of claim 5, further comprising squeezing the resilient covering of said exercise device with an amount of force sufficient to exercise the muscles of said user's hands and forearms.

8. The method of claim 5, further comprising:

grasping one of said opposed arms of said exercise device at said second segment in said first hand; and gripping said other opposed arm of said exercise device at said second segment in said second hand.

9. The method of claim 4, further comprising inverting said exercise device repetitiously, thereby exercising the muscles of the user's arms.

10. The method of claim 4, further comprising squeezing the resilient covering of said exercise device with an amount of force sufficient to exercise the muscles of said user's hands and forearms.

11. The method of claim 4, further comprising:

grasping one of said opposed arms of said exercise device at said second segment in said first hand; and gripping said other opposed arm of said exercise device at said second segment in said second hand.

* * * * *